US005298677A

United States Patent [19]

Shimada

[11] Patent Number: 5,298,677

[45] Date of Patent: Mar. 29, 1994

[54] AUTOMATIC PLAYING APPARATUS HAVING REDUCED MEMORY REQUIREMENTS

[75] Inventor: Yoshihisa Shimada, Hamamatsu, Japan

[73] Assignee: Kabushiki Kaisha Kawai Gakki Seisakusho, Hamamatsu, Japan

[21] Appl. No.: 937,808

[22] Filed: Aug. 28, 1992

[30] Foreign Application Priority Data

Aug. 30, 1991 [JP] Japan ..... 3-244084
Aug. 30, 1991 [JP] Japan ..... 3-244085

[51] Int. Cl.[5] ..... G10H 1/38; G10H 1/42

[52] U.S. Cl. ..... 84/635; 84/637; 84/DIG. 12; 84/DIG. 22

[58] Field of Search ..... 84/611-613, 84/635-637, DIG. 12, DIG. 22

[56] References Cited

U.S. PATENT DOCUMENTS 4,839,810 6/1989 Abe ..... 84/DIG. 12
5,164,531 11/1992 Imaizumi et al. ..... 84/DIG. 12

*Primary Examiner*—Stanley J. Witkowski
*Attorney, Agent, or Firm*—Joseph C. Mason, Jr.; Ronald E. Smith; Kaoru Kawanami

[57] ABSTRACT

An automatic playing apparatus according to the present invention, stores, in an automatic playing pattern data memory, chord, bass, drum data for each of a plurality of intro, normal and ending patterns, and drum data for each of a plurality of fill-in patterns, and reads, when a fill-in is selected via an operation panel, chord data and bass data, stored for an intro, normal, or ending pattern data, and drum data, stored for a fill-in pattern, to perform automatic playing. Further, an automatic playing apparatus according to the present invention includes an automatic playing pattern data memory wherein loud fill-in pattern data and soft fill-in pattern data are stored, sets an intonation value using an intonation dial as the performance is developed, and performs automatic playing based on either loud fill-in pattern data, if the intonation value is equal to or greater than a predetermined value, or based on the soft fill-in pattern data, if the intonation value is smaller than the predetermined value.

12 Claims, 11 Drawing Sheets

AUTOMATIC PLAYING APPARATUS HAVING REDUCED MEMORY REQUIREMENTS

BACKGROUND OF THE INVENTION

1. Field of the Invention

The present invention relates to an automatic playing apparatus that is used in an electronic musical instrument to accomplish automatic playing of designated rhythms, and to an automatic playing apparatus that is used in an electronic musical instrument to accomplish automatic playing in agreement with the performance development (intonation).

2. Description of the Related Art

Conventionally, an electronic keyboard, such as an electronic organ or electronic piano, has a memory wherein automatic playing patterns, including intro, fill-in, normal, and ending, are stored for each rhythm. Switches included on such an electronic keyboard are used to select appropriate automatic playing patterns during the music production process. The keyboard reads the selected patterns from the memory, and inserts corresponding phrases during the performance.

The individual automatic playing patterns comprise data for producing musical tones for chords, bass, and drums. The pattern data stored in the memory therefore include data for chords, bass and drums, while the automatic playing patterns include intro, fill-in, normal and ending.

As a result, when multiple automatic playing patterns are provided for each rhythm, the amount of pattern data is significantly increased and a large memory capacity is required.

Further, if fixed automatic playing patterns are inserted during the production process, rather than inserting phrases corresponding to single-phrase automatic playing patterns that are read from the memory, the performance becomes discontinuous, and a gradual change in the accompaniment that agrees with the intonation of the music performance is not possible.

The inventors of the present invention, therefore, have previously devised an automatic playing apparatus, for which a Japanese Patent Application is in pending (ref., Japanese Unexamined Patent Publication No. 58189/91), that features an intonation dial to be used to control the performance development, intending therewith to provide automatic accompaniment that agrees with the performance development.

With such an automatic playing apparatus that has an intonation dial, however, a fixed fill-in pattern is used when a fill-in is inserted; the apparatus fails, therefore, to adequately provide for performance development.

SUMMARY OF THE INVENTION

To resolve these shortcomings, it is the first object of the present invention to provide an automatic playing apparatus that can reduce the amount of data required for automatic playing patterns.

It is the second object of the present invention to provide an automatic playing apparatus that can insert fill-ins in agreement with the development of a performance.

To achieve the first object, an automatic playing apparatus according to the present invention has multiple automatic playing patterns for each rhythm, and stores multiple types of pattern data corresponding to these automatic playing patterns in an automatic playing pattern data memory. When one of the automatic playing patterns is selected via an operation panel, the automatic playing apparatus reads and uses the pattern data corresponding to the selected automatic playing pattern to perform automatic playing.

For each rhythm in the automatic playing pattern data memory, the automatic playing apparatus stores first pattern data, consisting of chord data, bass data and drum data, for intro, normal, and ending patterns, which are the first automatic playing patterns, and second pattern data, consisting of drum data, for a fill-in pattern, which is the second automatic playing pattern. When the fill-in pattern is selected via the operation panel, the automatic playing apparatus reads the drum data in the fill-in pattern, and the chord data and the bass data, but not the drum data, in the intro, normal or ending pattern, and thus performs automatic playing.

As the automatic playing apparatus of the present invention does not have to store chord data and bass data for fill-in pattern playing, the amount of pattern data is reduced and the memory storage capacity required for automatic playing pattern data is smaller.

To achieve the second object, an automatic playing apparatus according to the present invention comprises an automatic playing pattern data memory, for storing for each rhythm multiple automatic playing patterns and multiple fill-in playing patterns, which are specific automatic playing patterns having, at the least, loud fill-in pattern data, the first pattern data, and soft fill-in pattern data, the second pattern data, with the loud and soft fill-in pattern data having different intonations; an operation panel for selecting one of the automatic playing patterns stored in the automatic playing pattern data memory; an intonation dial for setting an intonation value in agreement with a development of performance; and a tone generator for, when either the loud fill-in pattern data or the soft fill-in pattern data is selected via the operation panel, selecting the loud fill-in pattern data if the intonation value set by the intonation dial is a predetermined value or greater, and selecting the soft fill-in pattern data if the intonation value is smaller than the predetermined value, thereby producing musical tones based on the selected pattern data.

The automatic playing apparatus of the present invention stores, at the least, loud fill-in and soft fill-in pattern data as specific fill-in automatic playing patterns in the automatic playing pattern data memory.

The intonation dial is operated to set an intonation value associated with the development of music. If an intonation value is set equal to or greater than a predetermined value, loud fill-in pattern data is read out, thereby performing loud fill-in playing. If an intonation value is set smaller than the predetermined value, soft fill-in pattern data is read out to perform soft fill-in playing.

Accordingly, when the intonation value is changed via the intonation dial and a fill-in pattern is inserted during stronger playing, loud fill-in playing that matches the current playing state will be performed. When the intonation value is changed via the intonation dial and a fill-in pattern is inserted during weaker playing, soft fill-in playing that matches the current playing state will be performed.

DETAILED DESCRIPTION OF THE PREFERRED EMBODIMENTS

(1) First Embodiment

Figure 1:
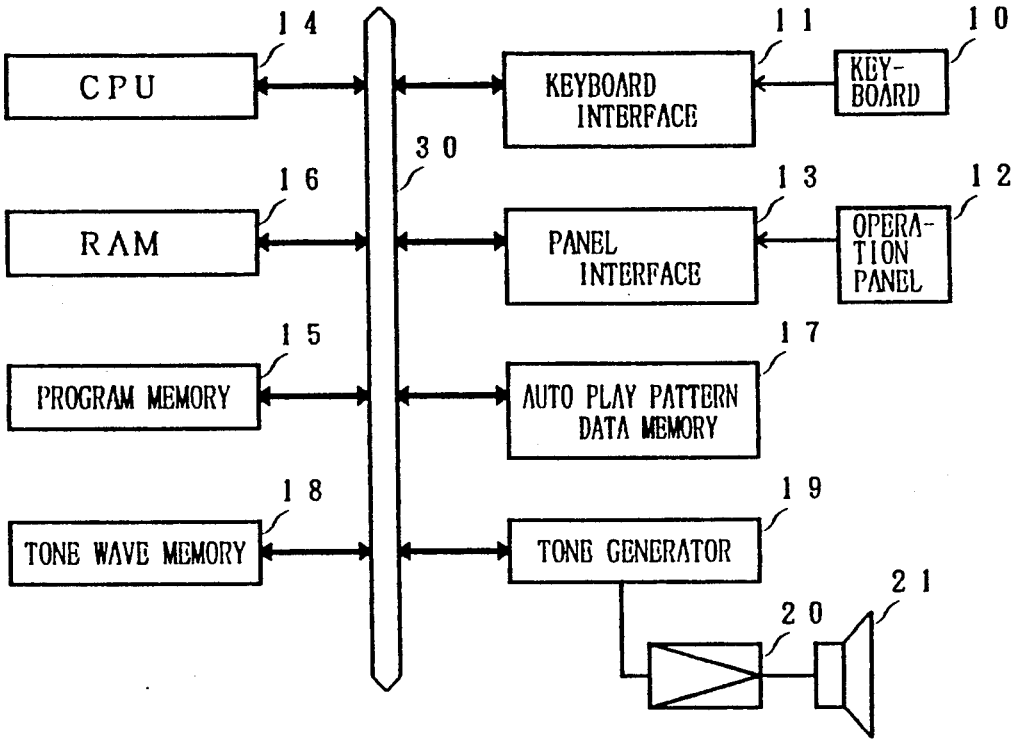
FIG. 1 is a schematic block diagram illustrating the general structure of an automatic playing apparatus according to one embodiment of the present invention.

FIG. 1 is a schematic block diagram illustrating the general structure of an automatic playing apparatus according to the first embodiment of the present invention.

A keyboard 10 includes multiple keys, key switches that open and close as keys are depressed and released, and a key scan circuit that detects the open or closed states of the key switches. Signals detected by the key scan circuit at the keyboard 10 are sent to a keyboard interface 11.

The keyboard interface 11 helps the keyboard 10 to exchange signals with a system bus 30. Signals that carry key depression/release are therefore sent from the keyboard 10 via the keyboard interface 11 and the system bus 30 to a Central Processing Unit (CPU) 14.

An operation panel 12 has various switches for controlling the automatic playing apparatus and a display.

These switches include a rhythm switch for starting rhythm playing, a fill-in switch for inserting a fill-in, an intro switch for automatically playing an intro pattern, and an ending switch for automatically playing an ending pattern, as well as general switches found on an electronic musical instrument, such as a timbre select switch, a rhythm select switch, and a volume switch (none of the switches are shown).

The rhythm switch is used to start automatic performance of a normal pattern in a rhythm selected by the rhythm select switch. The fill-in switch, which is a specific feature of the present invention, is used to insert a predetermined phrase, which is based on a given fill-in pattern, into current automatic playing to start fill-in automatic playing.

The intro switch is employed to start automatic playing of a normal pattern after a predetermined phrase based on an intro pattern is played. The ending switch is used to add a given ending pattern phrase to the current automatic playing to terminate automatic performance.

The operation panel 12 also includes a panel scan circuit that detects the ON/OFF states of these switches. Signals that carry the ON/OFF switch states detected by the operation panel 12 are sent to a panel interface 13.

The panel interface 13 is arranged between the operation panel 12 and the system bus 30 to receive and transmit signals. The signals from the operation panel 12 that carry the ON/OFF switch states, are sent via the panel interface 13 and the system bus 30 to the CPU 14.

The CPU 14 controls the individual sections of the automatic playing apparatus using a control program that is stored in a program memory 15.

The program memory 15 consists of, for example, a Read Only Memory (ROM). As described above, the control program is stored in the program memory 15. Besides the control program, various other fixed data that the CPU 14 uses are stored in the program memory 15. The program memory 15 is accessed by the CPU 14 via the system bus 30.

Reference numeral "16" denotes a Random Access Memory (RAM) 16. A work area for the CPU 14, various registers and flags, etc. for controlling the automatic playing apparatus are defined in the RAM 16. The RAM 16 is accessed by the CPU 14 via the system bus 30.

Figure 6:
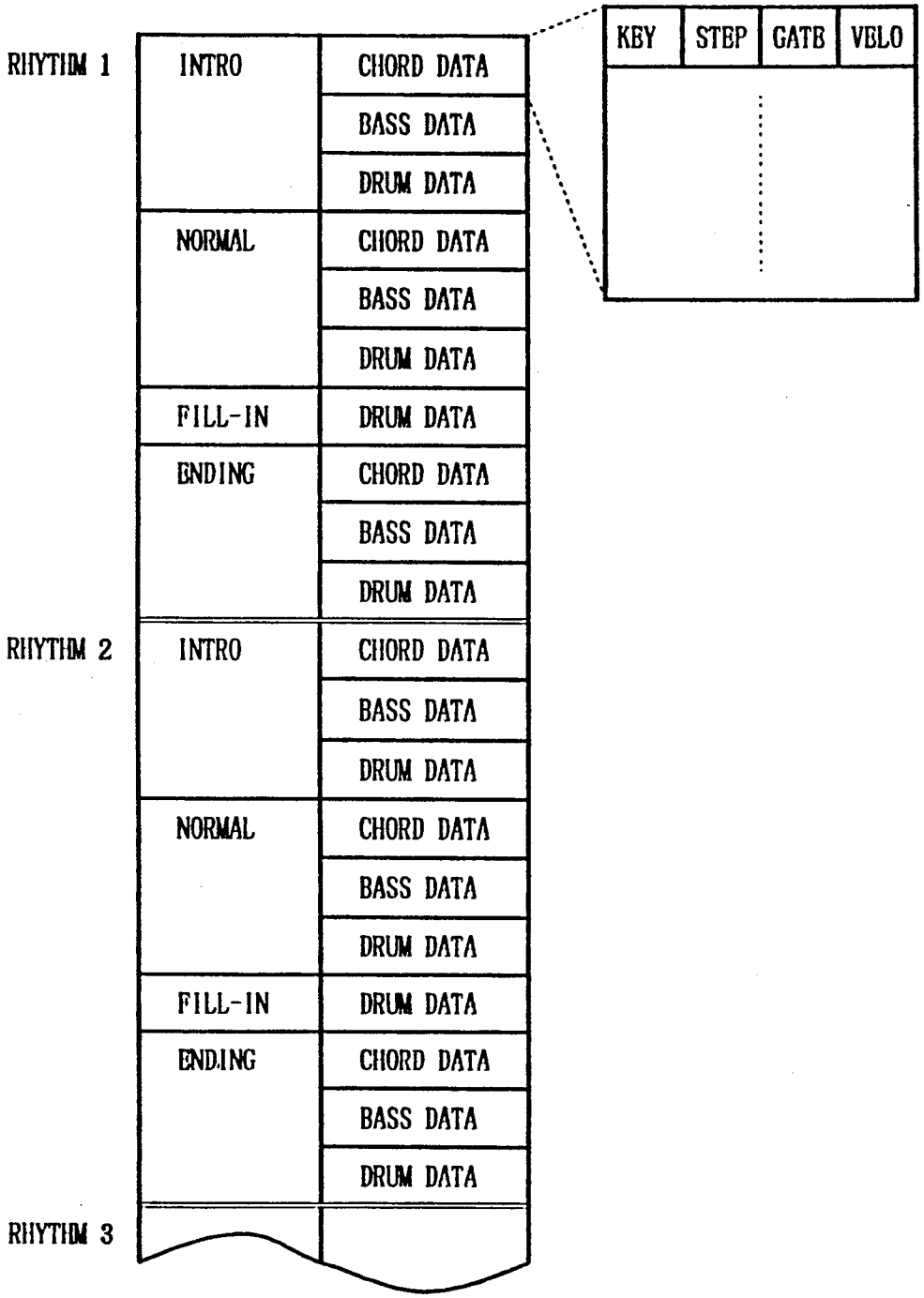
FIG. 6 is a diagram showing an example format for data storage in an automatic playing pattern data memory.

Reference numeral "17" is an automatic playing pattern data memory where pattern data for automatic playing are stored. FIG. 6 shows a format for data storage in the automatic playing pattern data memory 17.

Intro, normal, fill-in and ending pattern data are provided for each rhythm. The intro, normal and ending pattern data each have three tracks of chord, bass and drum data. The fill-in pattern data consists of only drum data.

The chord, bass, and drum data each have multiple play data for producing musical tones for one to several measures. In each case, the play data consist of key number KEY, measure END, or pattern END (all represented by "KEY" in FIG. 6), and step time STEP, gate time GATE and velocity VELO.

The key number KEY is a number denoting the corresponding key on the keyboard 10, and is used to select a pitch. The measure END is data showing the end of a measure. The pattern END is data showing the end of pattern data.

The step time STEP is data for designating the tone-ON time in a measure. The gate time GATE is data for designating the tone-ON duration. The velocity VELO is data for selecting the strength of a musical tone to be produced.

The automatic playing pattern data memory 17 is accessed by the CPU 14 via the system bus 30.

Reference numeral "18" in FIG. 1 denotes a tone wave memory where tone wave data and envelope data for various timbres and tone ranges are stored. The tone wave memory 18 is accessed by a tone generator 19 via the system bus 30.

The tone generator 19 reads tone wave and envelope data corresponding to data designated by the CPU 14 from the tone wave memory 18, and adds an envelope to the read-out tone wave data, outputting the result as a tone signal. This signal from the tone generator 19 is supplied to an amplifier 20.

The amplifier 20 amplifies the tone signal from the tone generator 19 by a predetermined gain, and supplies the amplified signal to a loudspeaker 21. The loudspeaker is a well known one that converts an electric signal into an acoustic signal.

The keyboard interface 11, the panel interface 13, the CPU 14, the program memory 15, the RAM 16, the automatic playing pattern data memory 17, the tone wave memory 18, and the tone generator 19 are mutually connected by the system bus 30.

With such an arrangement, the operation of this embodiment of the present invention will now be described referring to flowcharts shown in FIGS. 2 to 5.

Figure 2:
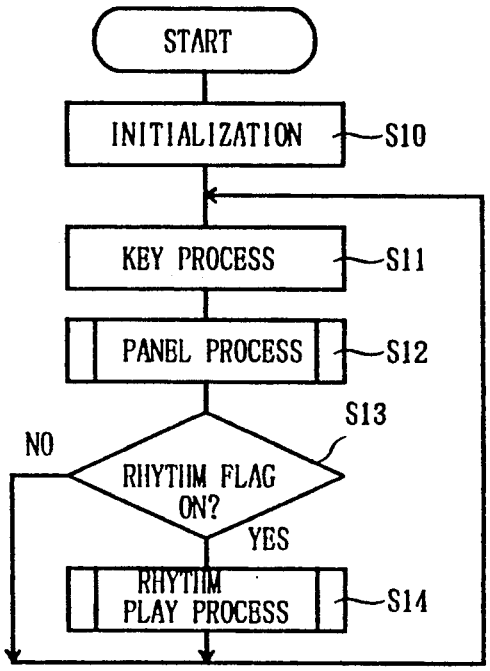
FIG. 2 is a main flowchart for explaining the operation of the embodiment of the present invention.
Figure 3:
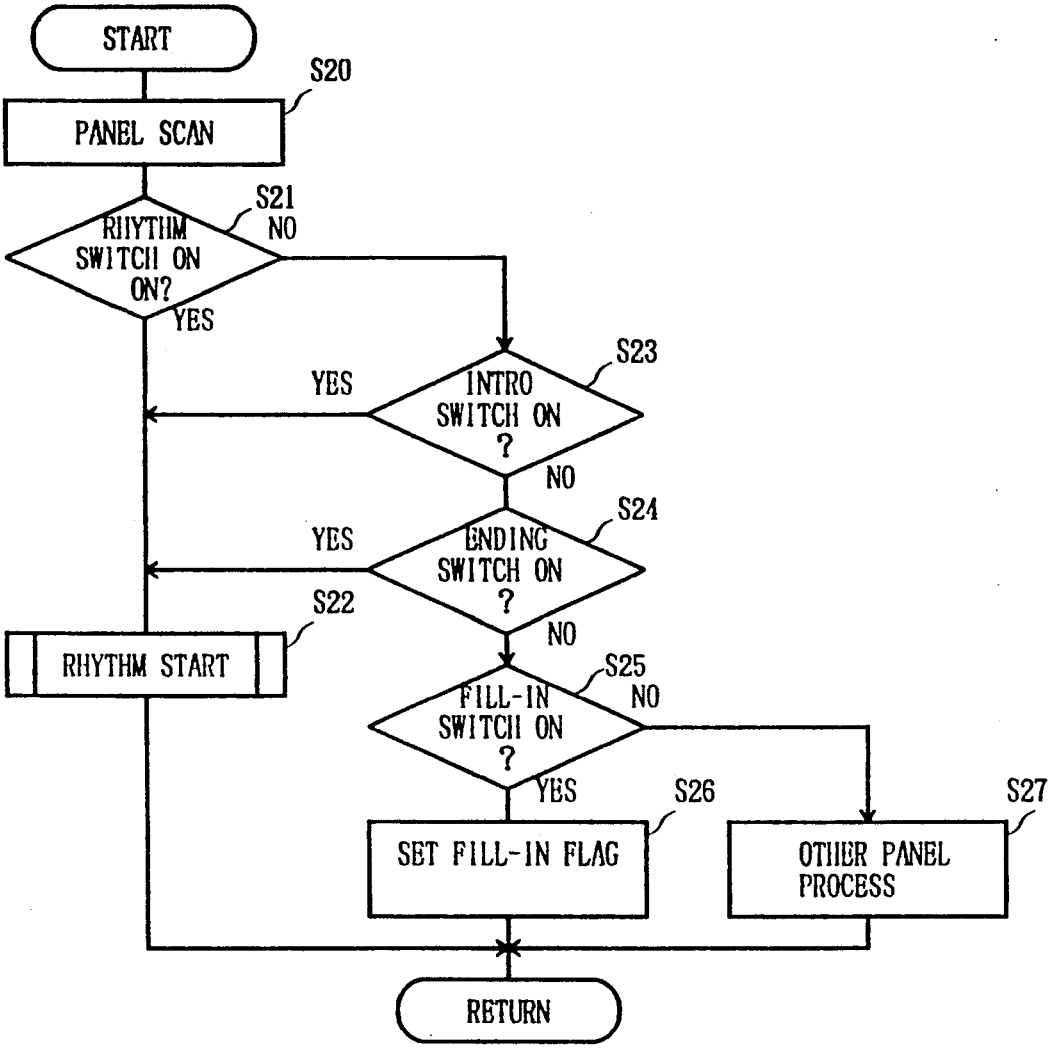
FIG. 3 is a flowchart for explaining a panel process in FIG. 2.

When power is switched on, initialization is performed as shown in FIG. 2 (step S10). During this process, the initial internal state of the tone generator 19 is established to prevent unwanted musical tones from being produced when power is switched on, a work area in the RAM 16 is cleared, and registers and flags are set to their initial values.

A key process is then performed (step S11). During this process, tone ON/OFF is controlled by depression/release of keys on the keyboard 10. Since the key process in this embodiment is well known, and does not directly concern the subject of the present invention, a detailed explanation of this process is not included.

Following this, a panel process is performed (step S12). The details of the panel process will be explained referring to a flowchart in FIG. 3.

First, a panel scan process is performed (step S20). More specifically, after the ON/OFF switch states are detected by the panel scan circuit at the operation panel 12, signals carrying the ON/OFF states are sent to the CPU 14 via the panel interface 13, and are stored in the RAM 16. Then the most recently obtained ON/OFF states are compared with the previously obtained ON/-OFF states (held in another area in the RAM 16) and an event map is prepared. In the event map, only those bits are set ON that represent switches on the operation panel 12 whose new ON/OFF state is ON.

Then, a check is performed to determine whether a rhythm switch is ON (step S21). This check is made by examining the event map that is prepared during the panel scan process. The following checks for the ON/-OFF states of the switches are performed in the same manner.

When a rhythm switch is not ON, a check is made to determine whether an intro switch is ON (step S23). When an intro switch is found to be ON, program control branches to step S22 to shift to a rhythm start process.

When an intro switch is not ON, a check is performed to determine if an ending switch is ON (step S24). If the ending switch is found to be ON, program control branches to step S22 to shift to a rhythm start process. If an ending switch is not ON, a check is then made to determine whether a fill-in switch is ON (step S25).

When a fill-in switch is found to be ON, a fill-in flag is set (step S26). Program control then returns from the panel process routine. In this manner, automatic playing using the fill-in pattern starts in the rhythm playing process routine (the details will be described later). The fill-in flag is a flag, provided in the RAM 16, that is used to indicate whether a fill-in pattern has been selected as an automatic playing pattern.

When, in step S25, the ON switch is not a fill-in switch, a process for that ON switch, e.g., a timbre select process, a rhythm select process, or a volume change process, is performed (step S27). Program control then returns from the panel process routine.

If, in step S21, a rhythm switch is found to be ON, a rhythm start process is immediately performed (step S22).

The rhythm start process will now be explained in detail referring to a flowchart in FIG. 4.

First, a check is made to determine whether the fill-in flag is set ON, i.e., whether the fill-in switch on the operation panel 12 is ON (step S30).

If the fill-in flag is not set ON, a chord head address, a bass head address, and a drum head address are set in the named order (steps S31 to S33).

More specifically, if either an intro, a rhythm or an ending switch, rather than a fill-in switch, is depressed, to start automatic playing that agrees with the depressed switch, head addresses are set for accessing chord, bass and drum data that are associated with a rhythm selected by the rhythm switch and that correspond to the depressed switch.

If the fill-in flag is found to be ON, the chord head address setting (step S31) and the bass head address setting (step S32) are omitted, and only the drum head address is set (step S33). Data for a currently used normal pattern are employed as chord and bass data, and data in a fill-in pattern are employed as drum data.

Next, a rhythm flag is set (step S34). The setting of the rhythm flag, located in the RAM 16, indicates whether rhythm automatic playing has been designated.

A rhythm counter COUNT is then cleared (step S35). The rhythm counter COUNT provides the tone-ON time, and is incremented at predetermined time intervals in accordance with music tempo.

After the panel process is completed, program control returns to the main routine. A check is performed to determine whether the rhythm flag is set ON (step S13). That is, a check is made to determine if rhythm playing has been selected by depression of the rhythm switch on the operation panel 12. If the rhythm flag is not ON, program control returns to step S11 and the above described processes are repeated.

If the rhythm flag is found to be ON, a rhythm playing process starts (step S14). Program control then returns to step S11 to repeat the above processes.

Normal playing and automatic playing are thus controlled and performed in response to the operation of the keyboard 10 and of the operation panel 12.

The rhythm playing process in step S14 will now be explained referring to the flowchart in FIG. 5. Since the rhythm playing processes for chord, bass and drum data are the same, the following describes a process for only one of these data types.

During the rhythm playing process, first, a check is made to determine whether it is time to read play data (step S40). More specifically, whether it is time for play data to be read from the automatic playing pattern data memory 17 is determined by checking for a read timing clock that is output by a timing clock generator (not shown). If it is not time to read play data, program control returns from the rhythm playing process routine without performing the following processes.

If it is time to read play data, the play data reading is performed (step S41). A check is then made to determine whether step time STEP, included in the read play data, equals the contents of the rhythm counter COUNT (step S42). If the step time STEP does not equal the contents of the rhythm counter COUNT, it is assumed that it is not yet the tone-ON time. Program control then returns from the rhythm playing process routine.

When the step time STEP equals the contents of the rhythm counter COUNT, a check is made to determine whether the previously read play data is pattern END information (step S43). This determination is made by checking a predetermined bit included in the first byte in the play data. A process for checking on the measure END (step S45) is performed in the same manner. When the read-out play data is found to be pattern END information, it is assumed that the rhythm playing process for a given measure is completed, and the rhythm start process is repeated (step S44). Since this process has already been described, an explanation of the process will not be repeated. Through the rhythm playing process, continuous rhythm playing is possible.

If, in step S43, the previously read play data is not pattern END information, a check is made to determine whether the play data is measure END information (step S45). When the play data is found to be measure END information, a check is then performed to determine whether the fill-in flag is set ON (step S46). If the flag is found to be set ON, it is cleared (step S47). As a result, for each depression of the fill-in switch fill-in playing for only one measure can be performed.

If, in step S45, the read-out play data is not measure END information, it is assumed that the play data is key number information, and a tone-ON process, based on the play data, is performed (step S48).

Then, the following play data in the pattern data is read out (step S49), and step time STEP in the read play data is loaded into a predetermined buffer (step S50). Program control returns to step S42 to repeat the above processes.

After the processes for all the play data that have the same step time STEP are completed, program control returns from the rhythm playing process routine.

If a fill-in is designated in a rhythm playing process, data for a normal pattern that is currently being performed (data designated by a chord head address and a bass head address that have been set before the rhythm start process starts) is used for chord and bass pattern data, and fill-in data (data designated by a drum head address that is set when the rhythm start process begins) are used for drum pattern data.

As described above, according to this embodiment, in the automatic playing pattern data memory 17, three types of data, i.e., chord, bass, and drum data, are stored as pattern data for each intro, normal, and ending automatic playing pattern, while only one data type, i.e., drum data, is stored as pattern data for fill-in automatic playing patterns.

When a fill-in is designated by the fill-in switch on the operation panel 12, tone generation is performed by reading drum data from the fill-in pattern data, and chord data and bass data from the normal pattern data.

By changing only the drum data portion in the normal pattern and performing a fill-in pattern, a slight musical variation is obtained.

With the above-described arrangement, it is not necessary to store chord and bass pattern data as fill-in pattern data. The amount of pattern data is thereby reduced, and the storage capacity required by the automatic playing pattern data memory 17 to store pattern data is smaller.

In this embodiment the use of intro, fill-in, normal and ending automatic playing patterns has been described. The automatic playing patterns that may be used, however, are not limited to these four types. Other, fewer or more, or other and fewer or more automatic playing patterns may be used, as long as the patterns used include, at the least, normal and fill-in patterns.

Further, although in this embodiment the pattern data for each intro, normal, and ending automatic playing pattern consist of chord, bass and drum data, and the pattern data for each fill-in automatic playing pattern consist of only drum data, the possible pattern data and the possible pattern data allocations that may be used are not limited to those described. As long as the pattern data types allocated for fill-in automatic playing patterns are fewer than those allocated for intro, normal, and ending automatic playing patterns the effect obtained is the same.

As described above in detail, according to this embodiment, it is possible to provide an automatic playing apparatus that can reduce the amount of automatic playing pattern data.

(2) Second Embodiment

The second embodiment according to the present invention will now be described referring to the accompanying drawings. Since the arrangement for controlling the music development using an intonation dial is explained in detail in Japanese Unexamined Patent Publication No. 58189/91, the explanation will not be repeated here. Only the arrangement for controlling soft fill-in and loud fill-in playing using an intonation dial will be explained in this embodiment.

Figure 7:
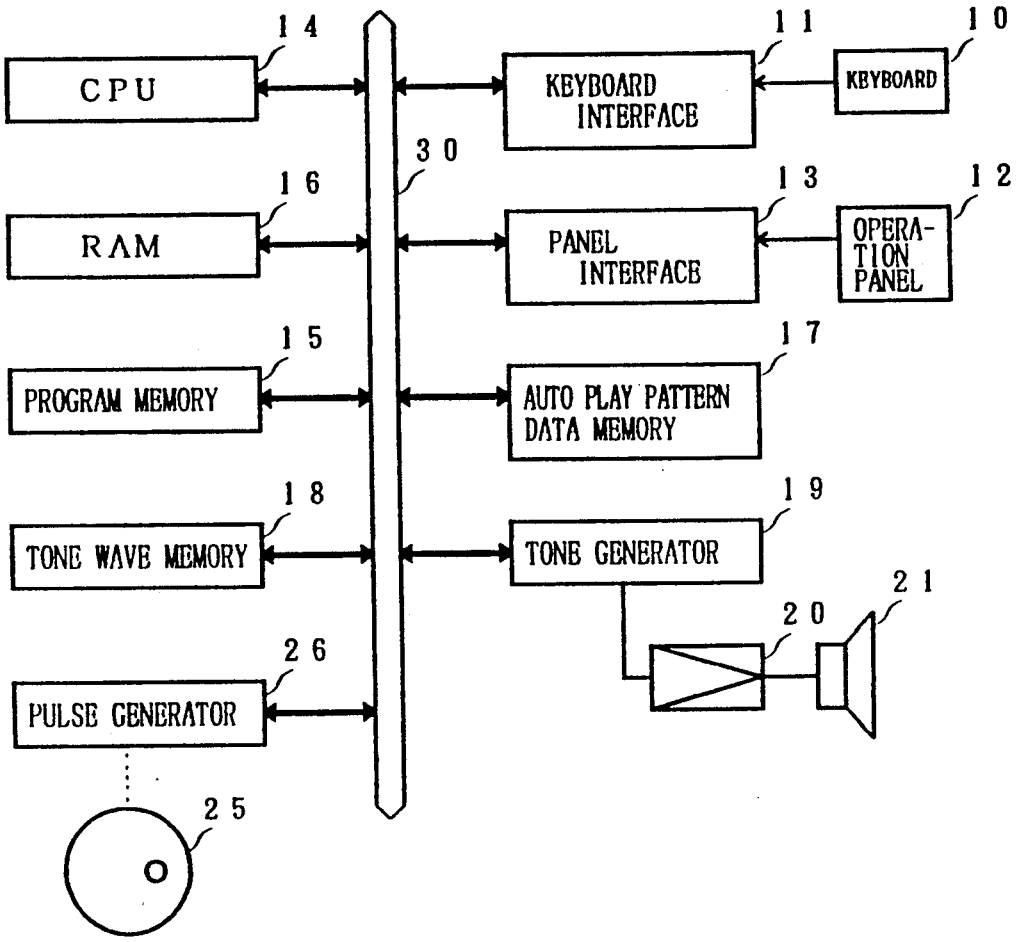
FIG. 7 is a schematic block diagram illustrating the general structure of an automatic playing apparatus according to another embodiment of the present invention.
Figure 8:
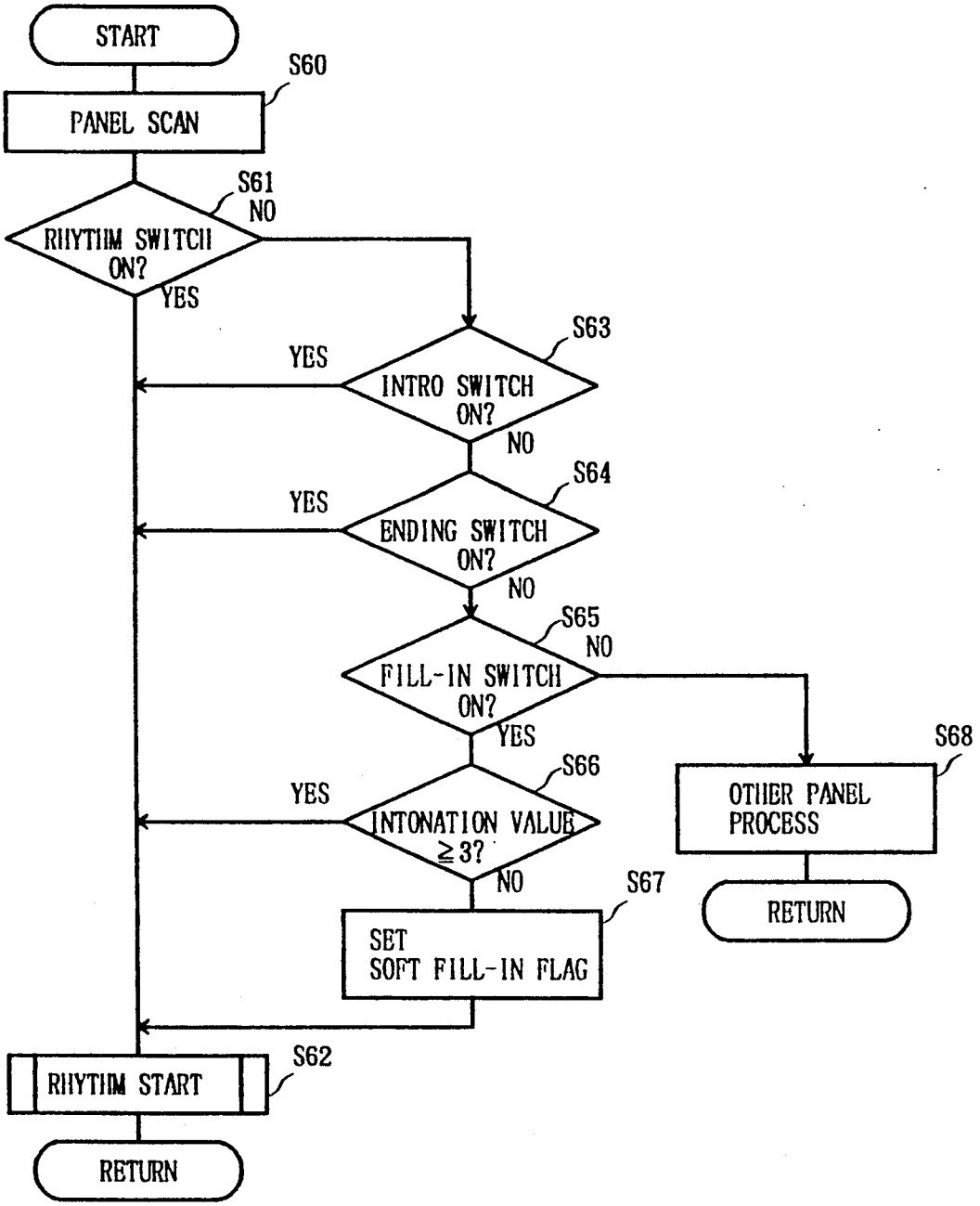
FIG. 8 is a flowchart for explaining the panel process in FIG. 2.

FIG. 7 is a schematic block diagram illustrating the general structure of an automatic playing apparatus according to the present invention. The structure of this embodiment is the same as the one shown in FIG. 1, except for the addition of an intonation dial 25 and a pulse generator 26, and the use of a different data storage format in the automatic playing pattern data memory 17. To avoid redundancy, the reference numerals used to denote components in FIG. 1 are also used to denote corresponding components in FIG. 7.

Figure 11:
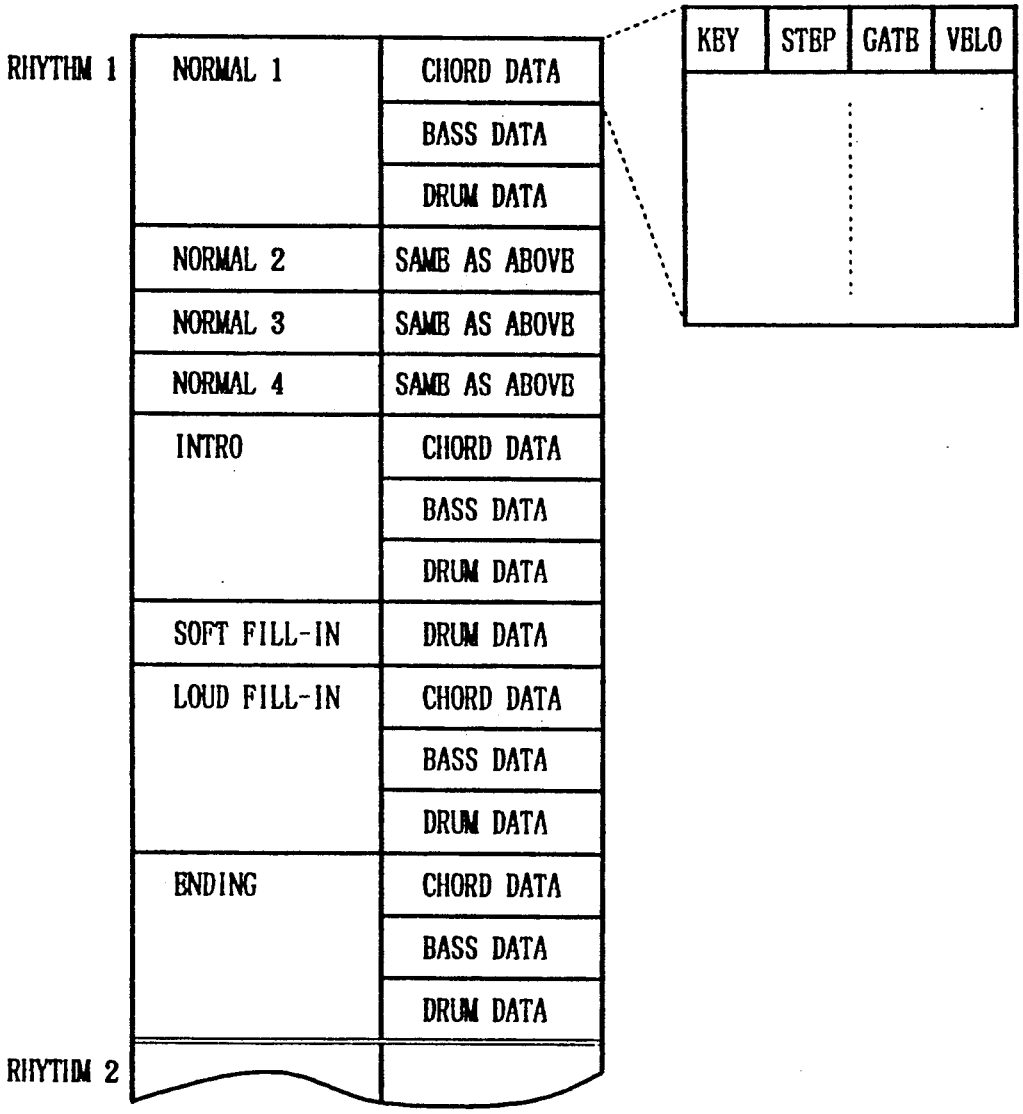
FIG. 11 is a diagram showing an example format for data storage in an automatic playing panel data memory.

FIG. 11 shows an example format for pattern data storage in the automatic playing pattern data memory 17.

In this example, normal 1 to 4, intro, soft fill-in, loud fill-in, and ending pattern data are prepared for one rhythm. In each normal 1 to 3, intro, loud fill-in, and ending pattern data group there are three tracks, chord, bass and drum data, while for the soft fill-in pattern data there is only one, drum data.

The chord, the bass, and the drum data all include multiple play data to produce musical tones for one to several measures, as in the first embodiment. The play data structure is the same as the one previously explained referring to FIG. 6.

The intonation dial 25 is used to select the level of the performance development. The intonation dial 25 is so designed that, in this example, an intonation value increases when the intonation dial 25 is turned clockwise, and decreases when it is turned counterclockwise. An output signal from the intonation dial 25 is supplied to the pulse generator 26.

As the intonation dial 25 is turned, the pulse generator 26 produces pulses in agreement with the degree of rotation of the intonation dial 25. The pulses generated by the pulse generator 26 are sent to the CPU 14 along the system bus 30. The CPU 14 counts the pulses to obtain the development information (intonation value). In this embodiment, the intonation value can vary within a range of 0 to 3.

The keyboard interface 11, the panel interface 13, the CPU 14, the program memory 15, the RAM 16, the automatic playing pattern data memory 17, the tone wave memory 18, the tone generator 19 and the pulse generator 26 are mutually connected by the system bus 30.

With such an arrangement, the operation of this embodiment of the present invention will now be described referring to flowcharts shown in FIGS. 2, and 8 to 10.

Since the main flowchart and its procedures in this embodiment are the same as those in FIG. 2, a detailed explanation will not be given. When power is switched on, an initialization process (step S10) and then a key process (step S11) are performed.

A panel process is then performed (step S12). The details of this process will be explained referring to the flowchart in FIG. 8.

In the panel process, first, a panel scan process is performed (step S60). This process is the same as that in step S20 in FIG. 2. Then, a check is performed to determine whether a rhythm switch is ON (step S61). This check is made by examining the event map that is prepared during the panel scan process. The following checks for the ON/OFF states of the switches are performed in the same manner.

When a rhythm switch is not ON, a check is made to determine whether an intro switch is ON (step S63). When an intro switch is found to be ON, program control branches to step S62 to shift to a rhythm start process.

When an intro switch is not ON, a check is performed to determine if an ending switch is ON (step S64). If an ending switch is found to be ON, program control branches to step S62 to shift to a rhythm start process. If an ending switch is not ON, a check is then made to determine whether a fill-in switch is ON (step S65).

When the fill-in switch is found to be ON, a check is made to determine whether a current intonation value is greater than or equal to 3 (step S66). An intonation value is obtained by the CPU 14 by counting the pulses that are generated by the pulse generator 26 as the intonation dial 25 is rotated.

If an intonation value is found to be 3 or greater, program execution branches to step S62 to start a rhythm start process. In this case, loud fill-in automatic playing will be performed.

If, in step S66, an intonation value is found to be smaller than 3, a soft fill-in flag is set (step S67). Program execution then branches to step S62 to start a rhythm start process.

In this manner, automatic playing using the soft fill-in pattern starts in the rhythm playing process routine (the details will be described later). The soft fill-in flag is a flag, provided in the RAM 16, that is used to indicate whether a soft fill-in pattern has been selected as an automatic playing pattern.

When, in step S65, the ON switch is not a fill-in switch, a process for that ON switch, e.g., a timbre select process, a rhythm select process, or a volume change process, is performed (step S68). Program control then returns from the panel process routine.

If, in step S61, a rhythm switch is found to be ON, a rhythm start process is immediately performed (step S62).

Figure 9:
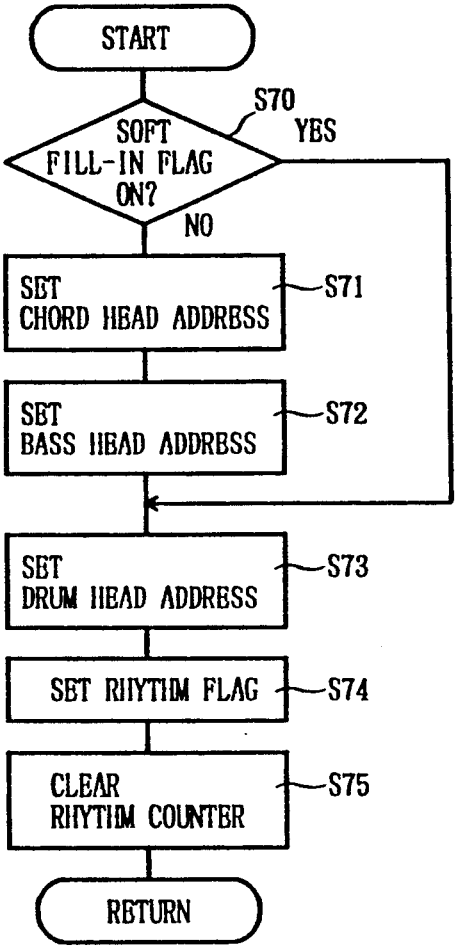
FIG. 9 is a flowchart for explaining a rhythm start process in FIG. 8.

The rhythm start process will now be explained in detail referring to the flowchart in FIG. 9. Procedures in this process are similar to those in the rhythm start process shown in FIG. 4.

First, a check is made to determine whether a soft fill-in flag is set ON, i.e., whether the fill-in switch on the operation panel 12 is set ON and whether an intonation value is smaller than 3 (step S70).

If a soft fill-in flag is not set ON, a chord head address, a bass address, and a drum address are set in the named order (steps S71 to S73).

More specifically, if any switch other than a fill-in switch is depressed, or if a fill-in switch is depressed and an intonation value is 3 or greater, to start automatic playing that agrees with the depressed switch, head addresses are set for accessing chord, bass and drum data that are included in an automatic playing pattern for a rhythm selected by the rhythm switch and that correspond to the depressed switch.

If a soft fill-in flag is found to be ON, the chord head address setting (step S71) and the bass head address setting (step S72) are omitted, and only the drum head address is set (step S73). Data for a currently used normal pattern are employed as chord and bass data, and data in a soft fill-in pattern are employed as drum data.

Figure 4:
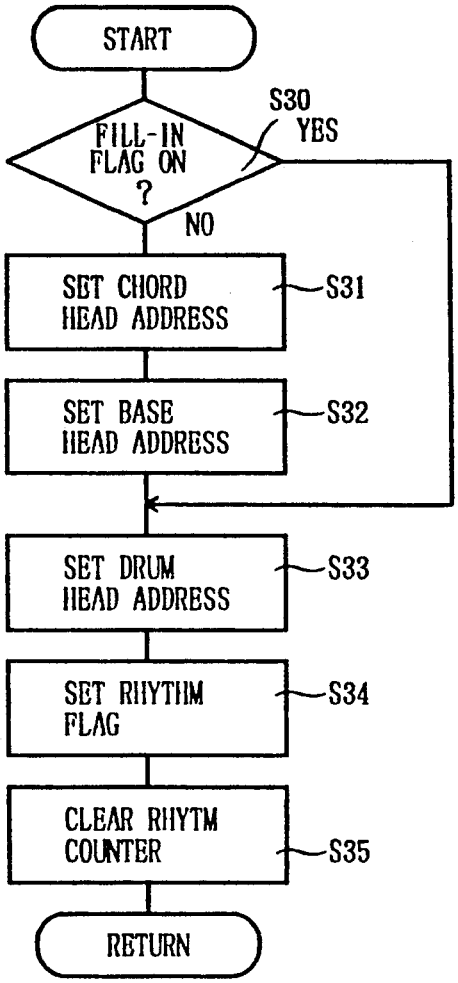
FIG. 4 is a flowchart for explaining a rhythm start process in FIG. 3.

Next, in the same manner as shown in FIG. 4, a rhythm flag is set (step S74) and a rhythm counter COUNT is cleared (step S75).

After the panel process is completed, program control returns to the main routine. A check is performed to determine whether the rhythm flag is set ON (step S13). If the rhythm flag is not ON, program control returns to step S11 and the above described processes are repeated.

If the rhythm flag is found to be ON, a rhythm playing process starts (step S14). Program control then returns to step S11 to repeat the above processes.

Normal playing and automatic playing are thus controlled and performed through the operation of the keyboard 10 and of the operation panel 12.

The rhythm playing process in step S14 will now be explained referring to the flowchart in FIG. 10. Since the rhythm playing process is similar to that in FIG. 5, different procedures will be mainly described.

Figure 5:
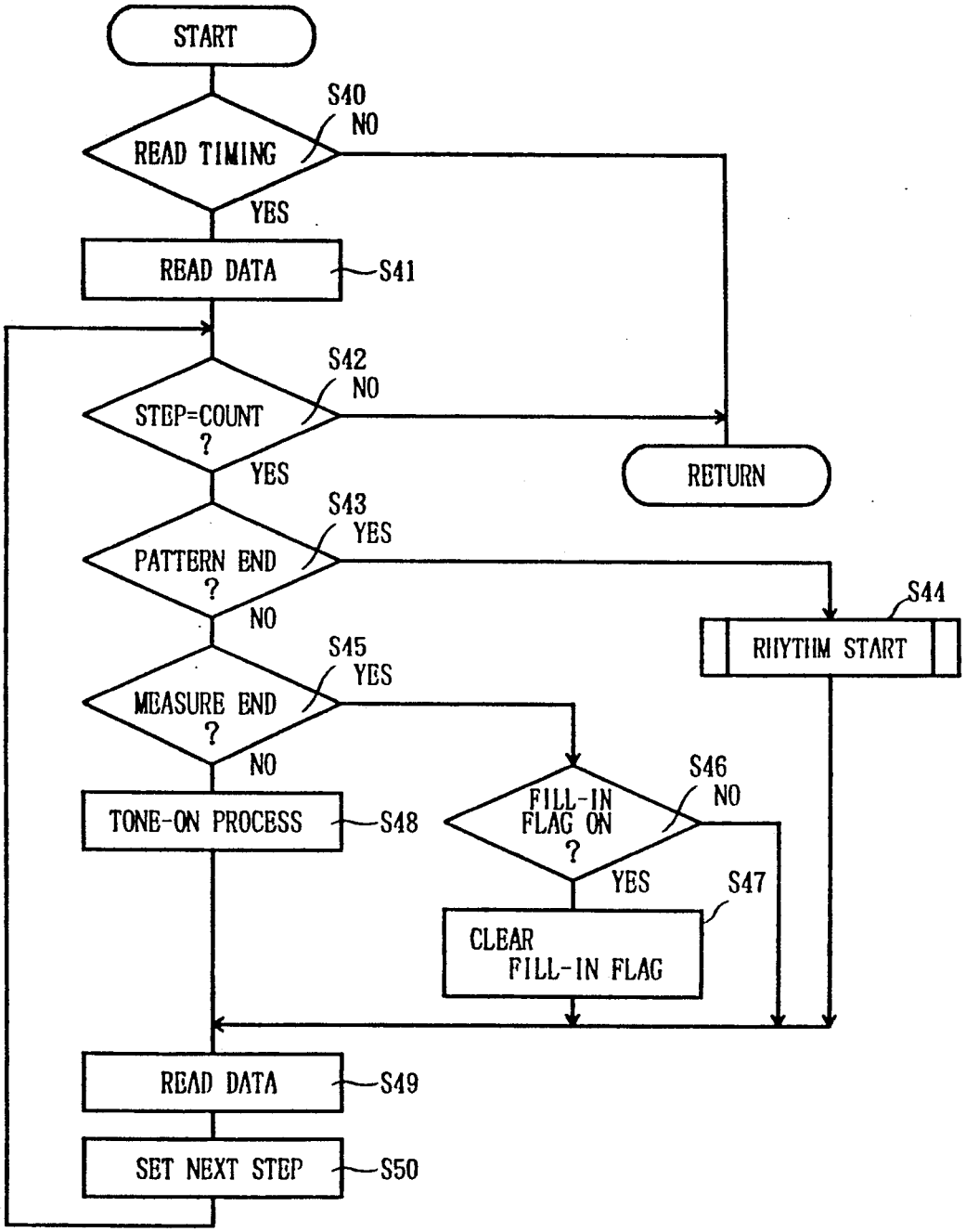
FIG. 5 is a flowchart for explaining a rhythm playing process in FIG. 2.
Figure 10:
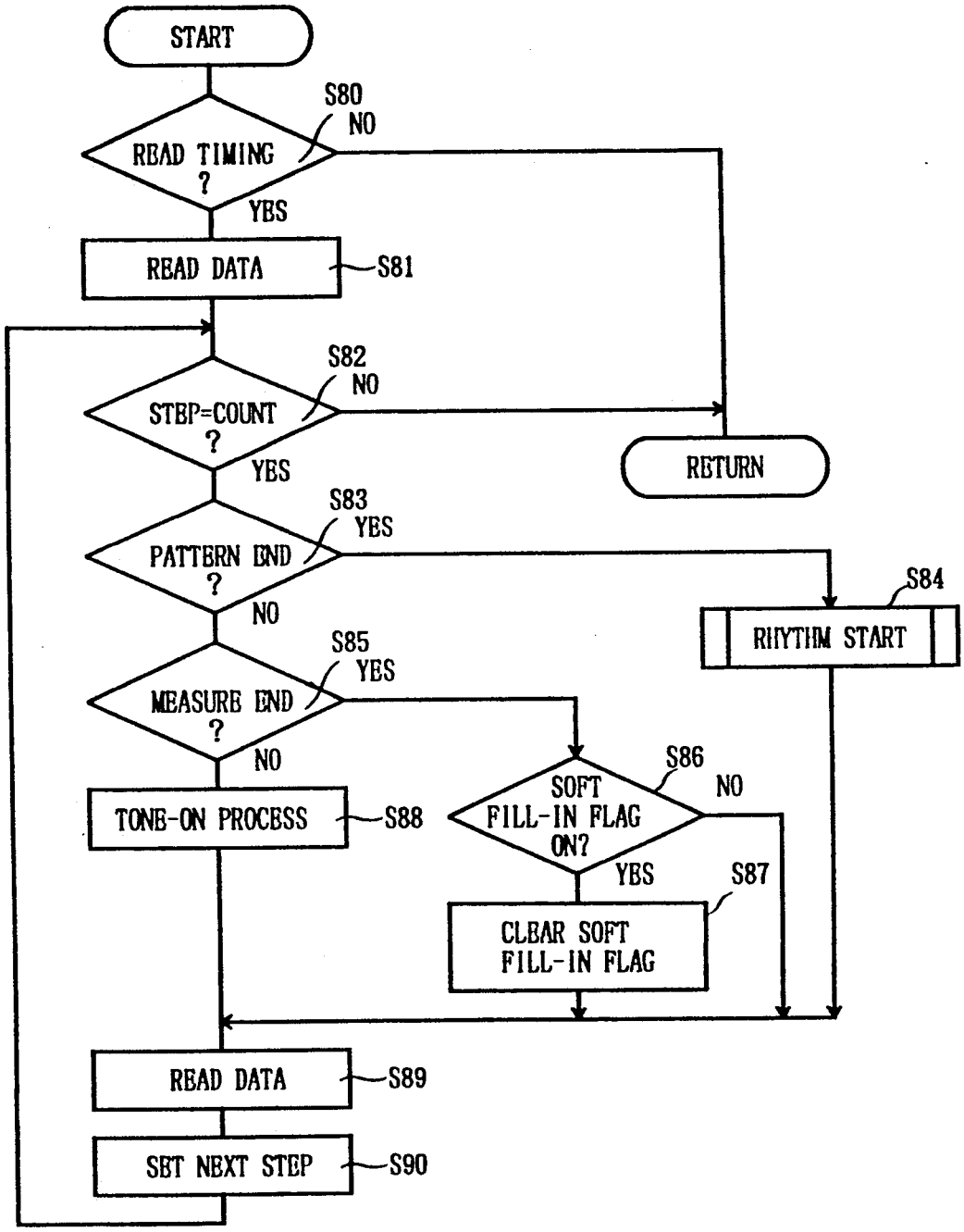
FIG. 10 is a flowchart for explaining the rhythm playing process in FIG. 2.

FIG. 10 shows a process for only one type of pattern data, as well as FIG. 5.

During the rhythm playing process, first, a check is made to determine whether it is time to read play data (step S80). If it is not time to read play data, program control returns from the rhythm playing process routine without performing the following processes.

If it is time to read play data, the play data reading is performed (step S81). Step time STEP included in the read-out play data is loaded as NEXT STEP into a predetermined buffer, and then a check is made to determine whether the contents of the buffer equal the contents of the rhythm counter COUNT (step S82). If the contents of the buffer do not equal the contents of the rhythm counter COUNT, it is assumed that it is not yet the tone-ON time. Program control then returns from the rhythm playing process routine.

When the step time STEP equals the contents of the rhythm counter COUNT, a check is made to determine whether the previously read-out play data is pattern END information (step S83). When the read-out play data is found to be pattern END information, it is assumed that the rhythm playing process for a given measure is completed, and the rhythm start process is repeated (step S84). Through the rhythm playing process, continuous rhythm playing is possible.

If, in step S83, the previously read play data is not pattern END information, a check is made to determine whether the play data is measure END information (step S85). When the play data is found to be measure END information, a check is then performed to determine whether the soft fill-in flag is set ON (step S86). If the flag is found to be set ON, it is cleared (step S87). As a result, for each depression of the fill-in switch, fill-in playing for only one measure can be performed.

If, in step S85, the read-out play data is not measure END information, it is assumed that the play data is key number information, and a tone-ON process, based on the play data, is performed (step S88). Since the tone-ON process is well known, a detailed explanation will not be included.

Then, the following play data in the pattern data is read out (step S89), and step time STEP in the read play data is loaded as NEXT STEP into a predetermined buffer (step S90). Program control returns to step S82 to repeat the above processes.

After the processes for all the play data that have the same step time STEP are completed, program control returns from the rhythm playing process routine.

If a soft fill-in is designated in a rhythm playing process, data for a normal pattern that is currently being performed (data designated by a chord head address and a bass head address that have been set before the rhythm start process starts) are used for chord and bass pattern data, and soft fill-in data (data designated by a drum head address that is set when the rhythm start process begins) are used for drum pattern data.

As described above, according to this embodiment, soft fill-in and loud fill-in pattern data are prepared for fill-in patterns, and when an intonation value is set to a predetermined value or greater by an intonation dial, i.e., when a fill-in is designated during a strong performance, loud fill-in pattern data is read out to perform loud fill-in automatic playing.

When the intonation value set by the intonation dial is smaller than the predetermined value, i.e., when a fill-in is designated during a weak performance, soft fill-in pattern data is read out to perform soft fill-in automatic playing.

As described above, since the automatic playing apparatus selects fill-in data in accordance with the performance development, it can provide fill-in automatic playing that agrees with the intonation of the music.

Three types of data, chord, bass and drum, are stored, in the automatic playing pattern data memory 17, as pattern data for each intro, normal, ending and loud fill-in automatic playing pattern, while only drum data is stored as pattern data for a soft fill-in pattern.

If fill-in playing is designated by a fill-in switch on the operation panel 12, and an intonation value is equal to or smaller than a predetermined value, musical tones are produced by reading drum data from the fill-in pattern data, and chord and bass data from normal pattern data.

As fill-in patterns are played by changing only the drum data of normal patterns, small musical variations are obtained and soft fill-in playing is possible.

With such an arrangement, it is not necessary to store chord and bass pattern data as soft fill-in pattern data. Accordingly, the amount of pattern data is reduced, and the required pattern data storage capacity of the automatic playing pattern data memory 17 is smaller.

In this embodiment, an automatic playing apparatus that has intro, fill-in, normal and ending automatic playing pattern data has been explained, but the automatic playing patterns that may be used are not limited to these four. The automatic playing apparatus may have other, fewer or more, or other and fewer or more types of automatic playing patterns.

Further, in this embodiment, while the data for each intro, normal, loud fill-in and ending pattern include chord, bass and drum data, and the data for each soft fill-in pattern include only drum data, the pattern data that may be used are not limited to these types, and other types of pattern data may be used.

As described above in detail, according to this embodiment, it is possible to provide an automatic playing apparatus that can insert a fill-in pattern that agrees with the level of the performance development, and that can reduce the amount of automatic playing pattern data.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, What is claimed is:

1. An automatic playing apparatus having a plurality of automatic playing patterns for every rhythm, having storage means for storing a plurality of types of pattern data corresponding to said plurality of automatic playing patterns, having selecting means for selecting one of said plurality of automatic playing patterns and having means for reading said selected automatic playing pattern to perform automatic playing, comprising:

said storage means storing a predetermined number of types of first and second pattern data relating to a first and second automatic playing pattern, respectively, and said storage means storing a fewer number of types of said second pattern data than said predetermined number of types of first pattern data; and control means for reading out said second pattern data and preselected parts of said first pattern data, when said second automatic playing pattern is designated by said selecting means, said preselected parts of said first pattern data being parts having no corresponding parts in said second pattern data so that no duplicative pattern data is read out, said reduced number of types of said second pattern data reducing the memory requirements of the apparatus.

2. An automatic playing apparatus according to claim 1, wherein said plurality of automatic playing patterns are intro, fill-in, normal and ending playing patterns.

3. An automatic playing apparatus according to claim 1, wherein said first automatic playing pattern is a normal playing pattern, and said second automatic playing pattern is a fill-in playing pattern.

4. An automatic playing apparatus according to claim 1, wherein said first pattern data are chord, bass, drum pattern data, and said second pattern data is drum pattern data.

5. An automatic playing apparatus, comprising:

storage means for storing a plurality of automatic playing patterns for every rhythm, including first pattern data and second pattern data that are prepared for different performance development levels are stored as specific automatic playing patterns;

designating means for designating one of said plurality of automatic playing patterns stored in said storage means;

setting means for setting an intonation value corresponding to a level of development of music;

selecting means for, when said specific automatic playing pattern is designated by said designating means, selecting said first pattern data if said intonation value set by said setting means is equal to or greater than a predetermined value, and selecting second pattern data if said intonation value is smaller than said predetermined value; and tone generating means for producing musical tones based on pattern data selected by said selecting means.

6. An automatic playing apparatus according to claim 5, further comprising third pattern data having a predetermined number of types, said third pattern data also being stored in said storage means and including a normal pattern for a normal automatic performance, said predetermined number of types of said third pattern data being fewer than said predetermined number of types of said second pattern data so that when said second pattern data are selected by said selecting means, said second pattern data and predetermined types of said third data are read from said storage means, said predetermined types of said third data being types not duplicative of types of said second pattern data, said apparatus thereby performing automatic playing and said apparatus having reduced memory requirements because duplicate data need not be stored in said storage means.

7. An automatic playing apparatus according to claim 5, wherein said plurality of automatic playing patterns are normal, intro, fill-in, and ending playing patterns.

8. An automatic playing apparatus according to claim 6, wherein said plurality of automatic playing patterns are normal, intro, fill-in, and ending playing patterns.

9. An automatic playing apparatus according to claim 5, wherein said specific automatic playing pattern is a fill-in playing pattern.

10. An automatic playing apparatus according to claim 6, wherein said specific automatic playing pattern is a fill-in playing pattern.

11. An automatic playing apparatus according to claim 5, wherein types of said third pattern data are chord, bass, and drum pattern data, and a type of said second pattern data is drum pattern data.

12. An automatic playing apparatus according to claim 6, wherein types of said third pattern data are chord, bass, and drum pattern data, and a type of said second pattern data is drum pattern data.

* * * * *